United States Patent [19]

Gregory

[11] Patent Number: 4,470,722

[45] Date of Patent: Sep. 11, 1984

[54] MARINE PRODUCTION RISER SYSTEM AND METHOD OF INSTALLING SAME

[75] Inventor: Edward W. Gregory, Calgary, Canada

[73] Assignee: Exxon Production Research Co., Houston, Tex.

[21] Appl. No.: 336,234

[22] Filed: Dec. 31, 1981

[51] Int. Cl.[3] ..... E21B 17/01

[52] U.S. Cl. ..... 405/195; 166/350; 405/303

[58] Field of Search ..... 175/7; 405/195, 303; 166/350, 359, 367

[56] References Cited

U.S. PATENT DOCUMENTS

| | | | |
|---|---|---|---|
| 3,330,340 | 7/1967 | Hayes et al. | 166/350 |
| 3,721,292 | 8/1971 | Ahlstone | 166/359 |
| 3,955,411 | 5/1976 | Lawson | 175/7 |
| 4,105,068 | 8/1978 | Tam | 175/7 |
| 4,176,986 | 12/1979 | Taft et al. | 405/195 |
| 4,213,720 | 7/1980 | Portass | 405/195 |
| 4,332,509 | 6/1982 | Reynard et al. | 405/195 |

OTHER PUBLICATIONS

Watkins and Howard, Buoyancy Materials for Offshore Riser Pipe, 1976.

*Primary Examiner*—Debbie L. Taylor

*Attorney, Agent, or Firm*—Alan J. Atkinson; Gary D. Lawson

[57] ABSTRACT

A method and apparatus is disclosed for a marine production riser system. The system includes a series of housing sections linked to form a vertical riser column. The integrity of the riser column is maintained by guidelines extending in tension between a subsea installation and a surface vessel. Each housing section has a plurality of passages extending therethrough. Fluid-handling lines retained within the passages are isolated from current forces by the housing sections. To utilize the invention, the nonbuoyant housing sections are positioned between the guidelines, are loosely banded to the guidelines, and are lowered to form the riser column. Fluid-handling lines are threaded through axially-coinciding passages located in each housing section and continuous throughout the riser column. The fluid-handling lines are connected at the sea floor and surface vessel to complete a fluid carrying system.

1 Claim, 5 Drawing Figures

24
23
21
25
25
28
28
16
13
14
17
15
15
10
17
17
11
12

MARINE PRODUCTION RISER SYSTEM AND METHOD OF INSTALLING SAME

BACKGROUND OF INVENTION

1. Field of the Invention

The present invention relates to a marine riser system and method of installing the riser and more particularly relates to an integrated, multi-conduit marine riser system to conduct fluids between the marine bottom and the surface.

2. Description of the Prior Art

In producing crude oil and natural gas in offshore areas, floating production systems have been used to transfer large volumes of fluids between subsea installations and the water surface. Floating production systems are becoming more attractive as petroleum production extends to water depths beyond the economic and physical limitation of fixed platforms and to distances beyond the economic limits of pipelines. Most floating production systems have wellheads and special production manifolds on or near the ocean floor and processing equipment and storage facilities on a moored floating vessel. Fluid-handling lines, or conduits, are used to transfer hydrocarbons between the subsea wellheads or manifold systems on the ocean floor and the vessel mounted production equipment.

Many floating production systems use a multi-conduit riser system to transfer fluids from the producing wells to the surface. The multi-conduit riser system should be easy to construct and must safely transport large quantities of petroleum to the surface.

A common multi-conduit production riser design utilizes a number of small diameter satellite conduits, or risers, disposed around a larger diameter central conduit. The satellite conduits are guided through appropriate passages in brackets attached to the central conduit. Movements of the surface vessel caused by wind and sea swell cause bending forces in the central conduit. These bending forces can be reduced by the incorporation of a flexible joint between the lower end of the central conduit and the well. Tensioners located on board the floating vessel can be used to independently tension the central conduit and each of the satellite conduits.

A principal shortcoming of a large conduit surrounded by smaller satellite conduits is that ocean waves and currents may produce vortex shedding forces that subject the riser system to excessive vibration and fatigue stresses. Vortex shedding occurs when water flows at high velocity around a riser. Vortices alternately shed from each side of the riser in a periodic fashion create pulsating forces leading to vibration of the central and satellite conduits. Vortex shedding is a particular problem in a multi-conduit riser system because the small diameter satellite conduits are more susceptible to bending than the larger central conduit.

The vortex shedding forces increase stress within the conduits by inducing vibrations within the conduits. These vibrations produce cyclic bending stresses at the brackets used to fasten the satellite conduits to the central conduit. When the conduits of a multi-conduit riser system vibrate at different frequencies, the system can experience fatigue cracks at the brackets fastening the conduits.

The vortex shedding forces further increase stress within the conduits by increasing the current drag forces bending the conduits. As a current impinges on a conduit, the current drag exerts a bending force against the conduit. This bending force induces stress at the brackets used to fasten the satellite conduits to the central conduit. Drag forces are magnified by vortex-induced vibrations because a vibrating conduit disrupts the current flow more than a stationary conduit does. This disruption increases the frictional forces impeding the current flow. The drag forces are particularly increased by the vibration of conduits in an exposed, multi-conduit riser because of the increased turbulence resulting from fluid flow around a combination of lines. The hydrodynamic forces resulting from this turbulence are extremely difficult if not impossible to accurately predict.

While fairings and other means can be used to suppress vortex-induced vibration of a single riser, there are no adequate means adapted to a multi-conduit riser. A need, therefore, exists for an improved multi-conduit production riser that will withstand the forces imposed by ocean waves and currents, is sufficiently flexible to tolerate vessel surge and sway on the surface of the water, and is easy to install.

SUMMARY OF THE INVENTION

The present invention comprises a marine riser system which includes at least two parallel guidelines extending between a subsea installation and a floating surface support means. The guidelines are tensioned by a tensioning means connected to the guidelines. A plurality of housing sections are slidably attached to the guidelines and released to form a riser column between the subsea installation and the floating surface support means. Each housing section has a plurality of passages extending vertically therethrough in axial alignment with the passages in adjacent housing sections. Fluid-handling lines threaded through the housing section passages carry fluids between the subsea installation and the surface support means.

The riser system of the present invention may be installed by first connecting the guidelines to the surface support means and the subsea installation. The guidelines, substantially parallel to each other, are moderately tensioned by tensioning means. Each housing section is loosely coupled to the guidelines and released. The nonbuoyant housing sections fall to the water surface and sink in the water to form a riser column supported by the guidelines. Additional housing sections are added until the riser column is constructed to a predetermined height preferably above the man water level. Each housing section is installed with the passages therethrough in axial alignment with correlative passages in the adjacent housing sections. Fluid-handling lines are threaded through the passageways of the housing sections and are connected to flow conduits on the subsea installation and surface vessel.

BRIEF DESCRIPTION OF THE DRAWINGS

The construction, operation, and apparent advantages of the present invention will be better understood by referring to the drawings in which.

DESCRIPTION OF THE PREFERRED EMBODIMENT

Figure 1:
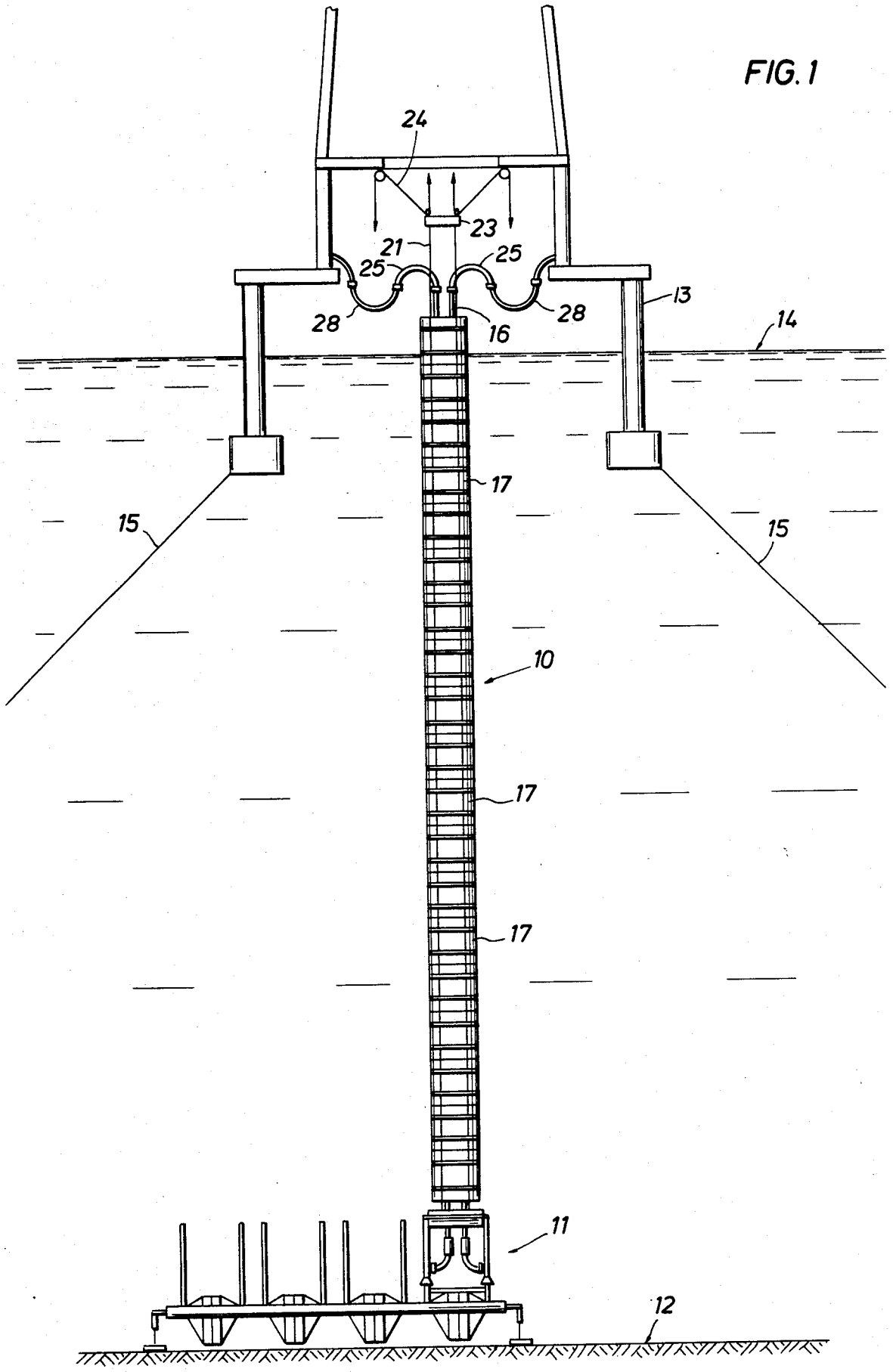
FIG. 1 is a schematic view of a riser column connecting a floating vessel to a submerged installation.
Figure 2:
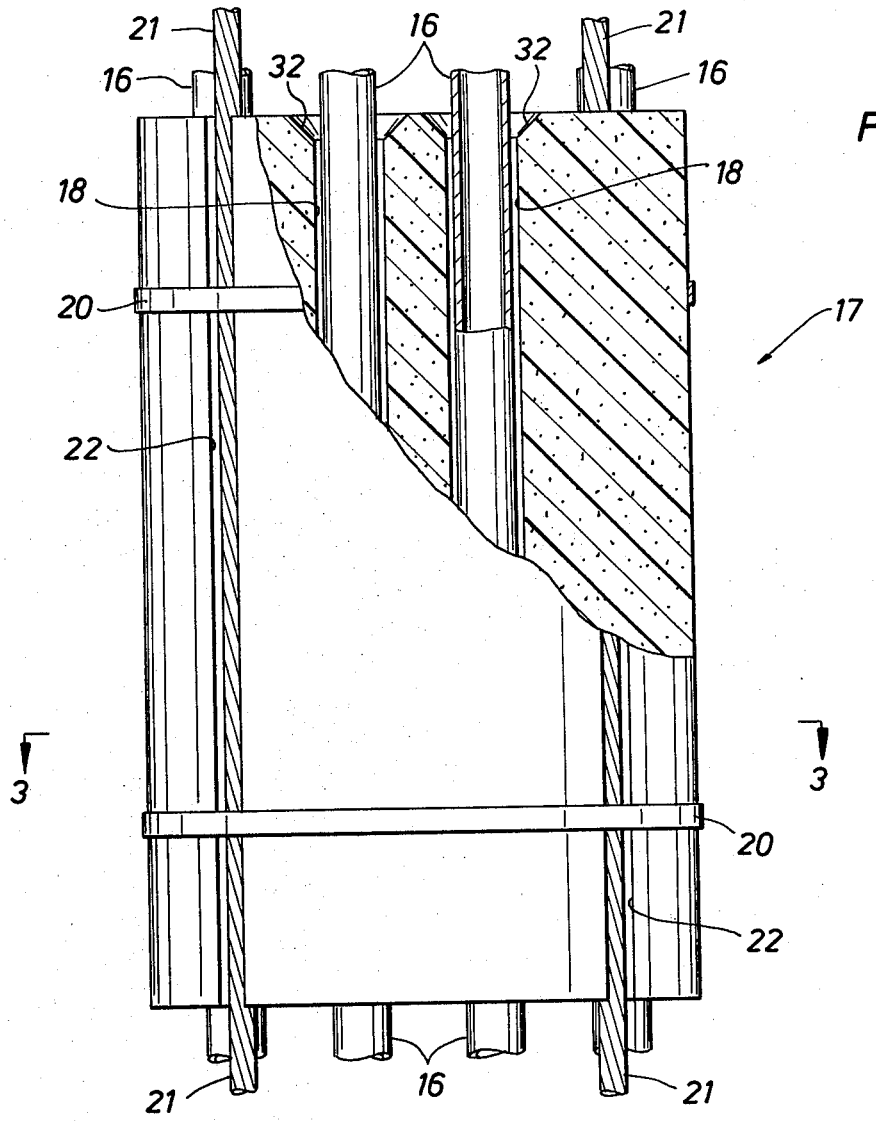
FIG. 2 is an enlarged elevation view of a housing section of the riser column of FIG. 1 with a portion cut away to show fluid handling lines.

Referring to FIG. 1 of the drawing, a marine riser column 10 of the present invention is connected at its lower end to a subsea installation or template 11 on the ocean floor 12. The marine riser column 10 is connected at its upper end to a semi-submersible production vessel 13 floating on the surface of a body of water 14. The vessel 13 is retained in a substantially fixed position over template 11 by anchor lines 15 to which anchors (not shown) are attached and sunk in the ocean floor. The template 11 has a cluster of deviated wells (not shown) which produce hydrocarbons. The hydrocarbons flow up the riser column 10 to treating facilites on-board the vessel 13.

Any surface support means adequate to support the riser column 10 can be used in place of the vessel 13. Also, the riser column 10 may be used with subsea installations other than a template 11. For example, the riser column may be connected to a collection base structure gathering petroleum from a system of satellite wells. Fluid-flowlines from the satellite wells direct the petroleum from the wells to the collection base structure for transport up the riser column to a floating vessel.

Referring to FIGS. 2–5, the riser column 10 comprises a plurality of housing sections 17 encasing a plurality of fluid-handling lines 16. The term "housing section" is used herein to describe a member which isolates the fluid-handling lines 16 from the surrounding water 14. The housing sections may be of any length, yet the upper and lower ends of each should be compatible with adjacent housing sections. Preferably, the housing sections 17 should be cylindrical to minimize current drag impinging against the riser column 10.

Each housing section has guide tubes or passages 18 that extend therethrough. The passages need not be positioned symmetrically within the housing sections but can be arranged in various orientations. The housing sections are coupled such that the passages through each are axially aligned with corresponding passages in adjacent housing sections. Fluid-handling lines 16 are retained in the passages 18 to carry fluids between the template 11 and the vessel 13. The housing sections can be attached by straps 20 or alternative means to flexible guidelines 21 made of steel cables or similar means. The straps 20 may preferably be made of galvanized steel, Kevlar (a Dupont Trademark fiber with a strength to weight ratio five times that ot steel), or stainless steel. The straps 20 hold the guidelines 21 in longitudinal grooves 22 located about the outer perimeter of the housing sections. The lower end of the guidelines 21 are attached by conventional means to the template 11, and the upper ends of the guidelines are attached to a tension distribution ring 23 or other tensioning means. Several tension carrying lines 24, such as steel cables or the like, connect the ring 23 to conventional tensioner systems (not shown) on board the vessel 13. The tensioner systems maintain a tension force on the guidelines 21 to enable the riser column to withstand lateral forces caused by sea currents.

Figure 3:
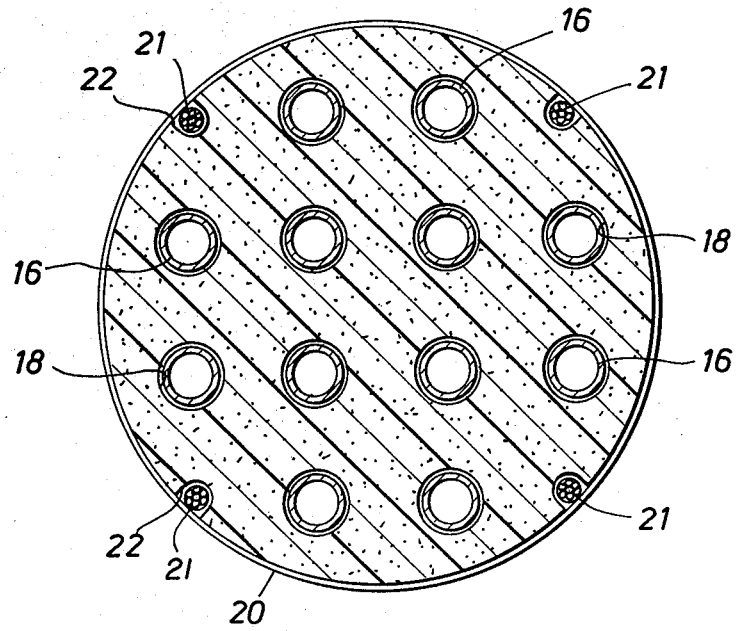
FIG. 3 is a section view of the riser column taken along line 3—3 of FIG. 2.

The riser column shown in FIG. 3 has twelve fluid-handling lines 16. The fluid-handling lines are shown having the same diameters, yet the lines need not number twelve nor is it necessary that all the lines have the same diameter. The various lines can be of the same diameter or differing diameters suitable for the fluid-handling requirements of the riser system. Preferably, the fluid-handling lines will have constant bore diameters throughout the length of the riser column to pemit passage of cleaning pigs or other tools as required. The handling lines 16 are constructed from a plurality of line segments. Each line segment may be any suitable length that can be installed or retrieved by equipment on the vessel 13. Line segment lengths of 10 meters or more are contemplated.

Figure 4:
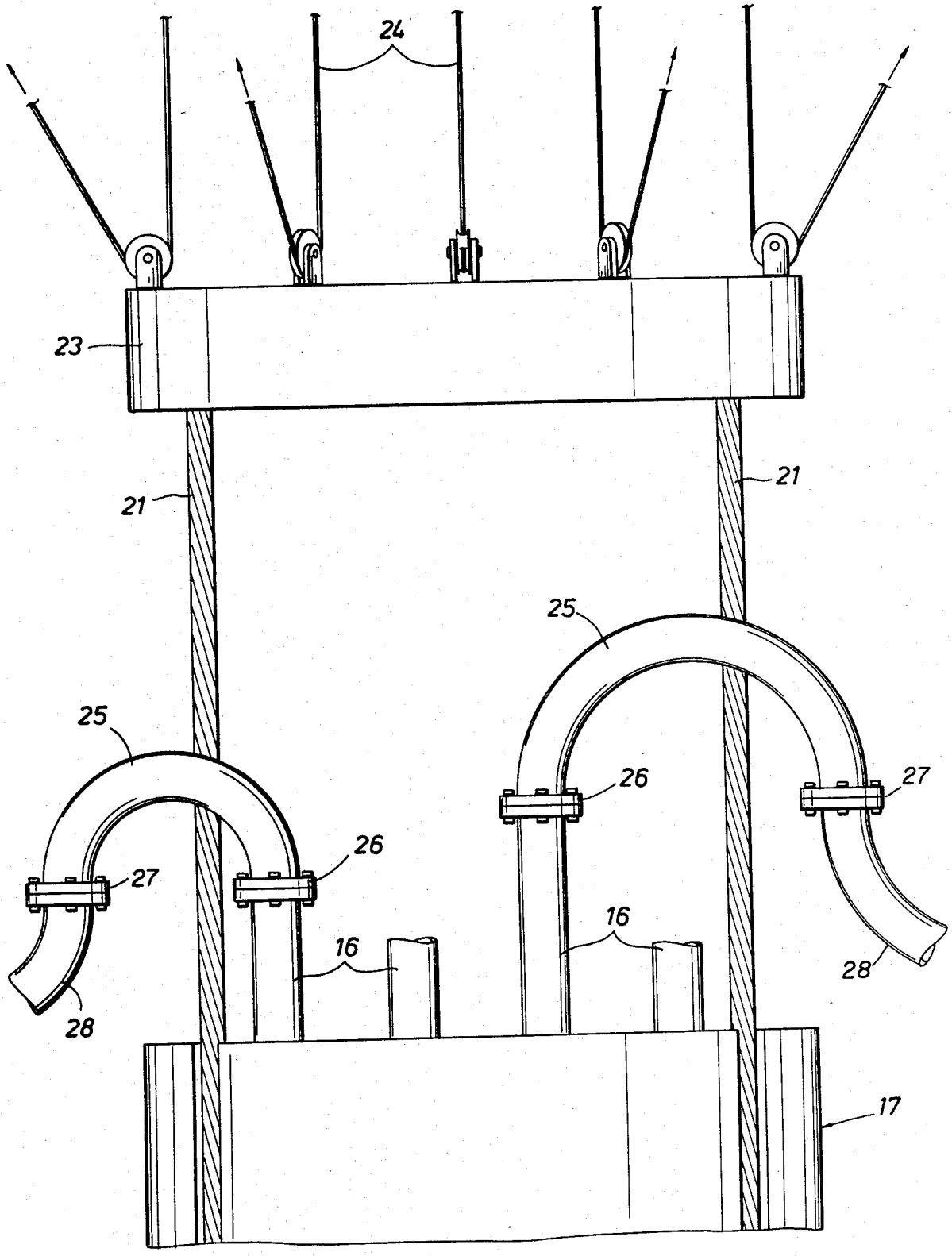
FIG. 4 is an enlarged elevation view of the top of the riser column of FIG. 1.

Referring to FIG. 4, the upper end of the fluid-handling lines 16 are connected to goose-necked, rigid lines 25 by connectors 26. For the sake of clarity, only two rigid lines are illustrated in FIG. 4. The rigid lines 25 are connected by connectors 27 to flexible drop hoses 28 that negotiate heave of the vessel relative to the riser column 10. The flexible drop hoses 28 may be replaced by any combination of flexible connections including swivels, telescopic joints, or other means.

Figure 5:
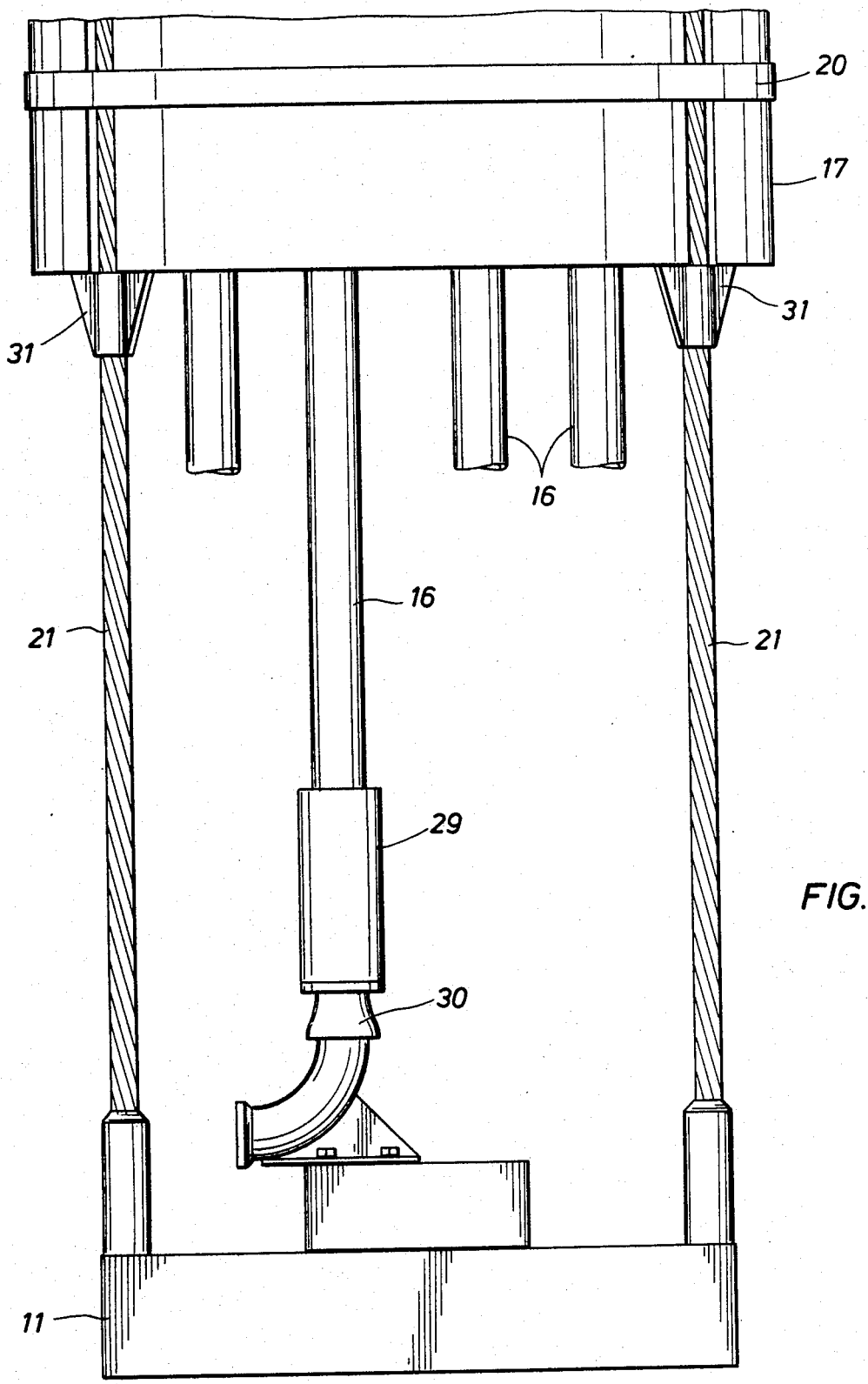
FIG. 5 is an enlarged elevation view of the bottom of the riser column of FIG. 1.

Referring to FIG. 5, the lower end of the fluid-handling lines 16 are attached to a stab connector 29. The stab connector 29 is of the type known in the art which will automatically lock upon insertion and will release upon rotation of the lines 16. Similar stab connections are illustrated on pp 2544–45 of the 1978–79 Composite Catalog of Oil Field Equipment and Services published by World Oil. The stab connector 29 is releasably connected to a universal joint 30 of the type known in the art, and the universal joint is connected to flow lines (not shown) on the template 11. The low housing section 17 is supported on stops 31 attached to the guidelines.

The housing sections 17 are fabricated with passages 18 sized to guide fluid-handling lines 16 through the riser column. For this reason, the housing section 17 design will depend on the size and number of fluid-handling lines to be used. Each housing section 17 is installed between the tensioning ring 23 and the surface of the water. The maximum length of each housing section should preferably, therefore, be limited to the distance between the ring 23 and water surface. Attachment of individual housing sections to the guidelines becomes more difficult as the housing section length exceeds about 5 meters. For this reason, housing section lengths ranging from 2 to 4 meters are preferred.

The horizontal profile of the housing sections should be built substantially identical to each other so that the sections can be stacked to form a riser column 10 with passages 18 that will permit installation of the fluid-handling lines. The housing sections should not be buoyant in the water in which the housing sections will be used. Preferably, the housing sections are made of a material such as syntactic foam that is slightly more dense than sea water so that the individual housing sections will sink in the water. The housing sections may be covered with an exterior coating material such as fiberglass, plastic, or other suitable material to form a moisture barrier as well as to protect the housing section against impact and abrasion. The housing sections shown in the drawings are cylindrical to minimize drag forces caused by ocean currents. However, to minimize hydrodynamic forces acting on the riser column, the housing sections can have other configurations suitable for a particular environment.

The upper end 32 of each passageway 18 is preferably conical shaped to aid in guiding the fluid-handling lines 16 through the riser column. Thus, even though the housing sections may be slightly offset from one another, the fluid-handling lines 16 can be lowered through the riser column 10 without striking the top of a particular housing section 17. Although not necessary to practice this invention, the passages 18 may be lined with metal or other wear-resistant material to protect the syntactic foam when running or pulling fluid-handling lines 16 through the riser column.

FIG. 3 shows four guidelines 21 held in grooves 22 by straps 20. However, the guidelines need not number four. For example, two guidelines 21, one on each side of the riser column, or three guidelines spaced circumferentially about the riser column may also be used to support this invention. The use of four guidelines is preferred to provide redundancy in the event a guideline breaks or otherwise loses tension. The guidelines need not be retained in the grooves 22 as shown in the drawings. Retention of the guidelines in the grooves is preferred to minimize drag forces on the riser column. However, the housing sections may be attached to guidelines in any other suitable manner. The only requirement is that each housing section 17 be slidably attached to the guidelines 21 so that the coupled housing sections 17 can be vertically aligned to permit fluid-handling lines 16 to be lowered therethrough.

Having described all the components of this invention, the preferred method of installing the riser column 10 will now be described. First, guidelines 21 are attached to template 11 and to tension ring 23 by techniques well known in the art. The guidelines 21 are then moderately tensioned with appropriate tensioning means. Next, individual housing sections 17 are inserted between the guidelines below the tension ring 23 and preferably above the water surface. If tension on the guidelines makes it difficult to insert the housing sections between the guidelines, tension on the lines may be reduced to make separation of the guidelines easier. Alternatively, a grappling tool (not shown) can be used to pull two guidelines apart to facilitate entry of the housing section between the guidelines. Once the housing section is in place, i.e. the guidelines 21 are in grooves 22, the housing section is preferably secured to the guidelines by straps 20. After the housing section is secured to the guidelines, it is released and allowed to slide down the guidelines to rest on stops 31 or on top of the last housing section released. This procedure continues until the top of the riser column reaches a predetermined height, preferably just above the mean wave height of the water.

Line segments are assembled into individual fluid-handling lines 16 as the fluid-handling lines are threaded through guide passages 18 in the riser column sized to accommodate the lines. The lower ends of the fluid-handling lines 16 are attached to stab connectors 29 on the template 11. The upper ends of the fluid-handling lines 16 are connected to rigid pipes 25 which in turn are connected to flexible drop hoses 28. A pressure test is then performed on each fluid-handling line 16 to verify a leak-tight connection in all connectors and joints.

The production riser system of the present invention is resistant to fatigue caused by riser column bending in the wave zone. The invention eliminates the need for a large central support column in a riser which is a major source of complexity and expense. The invention reduces the drag forces and vibrations associated with vortex shedding around multi-conduit production risers. By eliminating the current flow around multiple risers and substituting a single exterior shape, the invention provides a profile for accurately predicting the hydrodynamic forces acting on the riser column.

Various modifications and alterations to this invention will become apparent to those skilled in the art without departing from the scope of this invention. It should be understood that this invention is not to be unduly limited to that set forth herein for illustrative purposes.

What is claimed is:

1. A method of installing a compliant marine riser system between a subsea installation and a surface support means comprising:

extending at least two guidelines between the subsea installation and the surface support means, and tensioning said guidelines with tensioning means;

coupling a negatively buoyant housing section in sliding engagement with the guidelines, said housing section having a passage extending vertically therethrough;

releasing said housing section to permit it to sink in the water along the guidelines until said housing section reaches a predetermined location;

coupling and releasing additional sections to said guidelines to permit each housing section to sink in the water along said guidelines until each housing section rests on top of the preceeding housing section, wherein additional housing sections are coupled and released until a column of housing sections, which is structurally supported by said guidelines, is formed to a predetermined height;

passing a fluid-handling line through said passages in said housing sections; and connecting the lower end of said fluid-handling line to said subsea installation.

* * * * *